US005255998A

United States Patent [19]

Beretta

[11] Patent Number: 5,255,998

[45] Date of Patent: Oct. 26, 1993

[54] MULTIPLE-LAYER NET STRUCTURE FOR FLUID DRAINAGE, PARTICULARLY FOR GEOTECHNICAL USE

[75] Inventor: Mario Beretta, Sirtori, Italy

[73] Assignee: RDB Plastotecnica S.p.A., Brianza, Italy

[21] Appl. No.: 972,683

[22] Filed: Nov. 6, 1992

[30] Foreign Application Priority Data

Nov. 12, 1991 [IT] Italy ..... MI91A003004

[51] Int. Cl.[5] ..... E02D 5/00; E02B 11/00

[52] U.S. Cl. ..... 405/36; 134/DIG. 1; 405/16; 405/43; 405/258; 428/225

[58] Field of Search ..... 139/DIG. 1; 405/258, 405/20, 21, 15–19, 36, 43, 45; 428/225, 232, 294

[56] References Cited

U.S. PATENT DOCUMENTS

| | | | |
|---|---|---|---|
| 2,244,835 | 6/1941 | Goldstein | 139/DIG. 1 |
| 2,842,472 | 7/1958 | Hartstein | 428/232 X |
| 2,985,941 | 5/1961 | Riedesel et al. | 139/DIG. 1 |
| 3,446,251 | 5/1969 | Dow | 139/DIG. 1 |
| 3,479,244 | 11/1969 | Burnett | 428/232 X |
| 3,769,142 | 10/1973 | Holmes et al. | 428/225 X |
| 4,191,219 | 3/1980 | Kaye | 139/DIG. 1 |
| 4,421,439 | 12/1983 | Burg et al. | 405/258 |

*Primary Examiner*—Dennis L. Taylor

*Attorney, Agent, or Firm*—Guido Modiano; Albert Josif

[57] ABSTRACT

The multiple-layer net structure has a first layer of mutually parallel wires which is rigidly associated with a second or intermediate layer of substantially mutually parallel wires, which are inclined with respect to the wires of the first layer. A third layer of wires is rigidly associated with the intermediate layer, on the opposite side thereof with respect to the first layer, and has substantially mutually parallel wires which are inclined with respect to the wires of the second or intermediate layer.

13 Claims, 1 Drawing Sheet

MULTIPLE-LAYER NET STRUCTURE FOR FLUID DRAINAGE, PARTICULARLY FOR GEOTECHNICAL USE

BACKGROUND OF THE INVENTION

The present invention relates to a multiple-layer net structure for fluid drainage, particularly for geotechnical use.

As is known, in civil engineering, geotechnical and other applications nets are used which have the purpose of ensuring the drainage of fluids through them.

Known methods use biplanar or substantially biplanar nets, i.e. nets constituted by two series of wires which intersect at a preset angle; said nets are manufactured for example by extruding plastic material with known contrarotating nozzles provided with recesses or holes capable of extruding the wires.

In said drainage systems, in order to drain liquids for example from any buried accumulation regions, it is known to arrange a layer of biplanar two-wire nets. The nets may be coupled to one or two layers, one for each face, of a filtering fabric which has the purpose of preventing clogging of the net due to the accumulation therein of solid particles of various kinds, such as soil or others.

Said nets are buried and inclined with respect to the horizontal plane, so as to allow the drainage of any liquids to be eliminated from the region in which the drainage nets are located, collecting them in another region.

A typical example of application of said nets can be the one in which the nets, coupled to filtering fabrics, are arranged on the sides and on the bottom of solid waste collection basins, urban landfills, wherein the drainage system is necessary in order to remove the liquids which form, in the course of time, due to the degradation of said solid waste and which, due to their chemical nature, might corrode the plastic membrane applied on the bottom of the landfill or might, worse still, percolate into the soil if the membrane were to break at any point.

In other applications, these nets are used to drain rainwater from regions to be kept dry, such as buried walls or others.

Although this type of net is widely used, it has been found to be susceptible to improvement, especially as regards the possibilities of obtaining efficient drainage of the liquids, which are in practice conveyed by the layers.

SUMMARY OF THE INVENTION

The aim of the invention is indeed to solve the above problem by providing a multiple-layer net structure for fluid drainage, particularly for geotechnical use, which introduces new elements, achieving unexpected advantages with respect to the systems used so far.

Within the scope of the above aim, a particular object of the invention is to provide a multiple-layer net structure which increases the flow-rate of the drained fluid with respect to the solutions of the known art.

Another object of the present invention is to provide a multiple-layer net structure which, by virtue of its particular constructive characteristics, is capable of giving the greatest assurances of reliability and safety in use.

Not least object of the present invention is to provide a multiple-layer net structure which can be obtained with known machines and without introducing particular manufacturing problems.

This aim, these objects and others which will become apparent hereinafter are achieved by a multiple-layer net structure for fluid drainage particularly for geotechnical use, according to the invention, characterized in that it comprises a first layer of substantially mutually parallel wires rigidly associated with a second or intermediate layer of substantially mutually parallel wires which are inclined with respect to the wires of said first layer, a third layer of wires being rigidly associated with said intermediate layer on the opposite side with respect to said first layer and being constituted by wires which are substantially mutually parallel and inclined with respect to the wires of said intermediate layer.

BRIEF DESCRIPTION OF THE DRAWINGS

Further characteristics and advantages will become apparent from the description of a preferred but not exclusive embodiment of a multiple-layer net structure, illustrated only by way of non-limitative example in the accompanying drawings, wherein.

DESCRIPTION OF THE PREFERRED EMBODIMENTS

Figure 1:
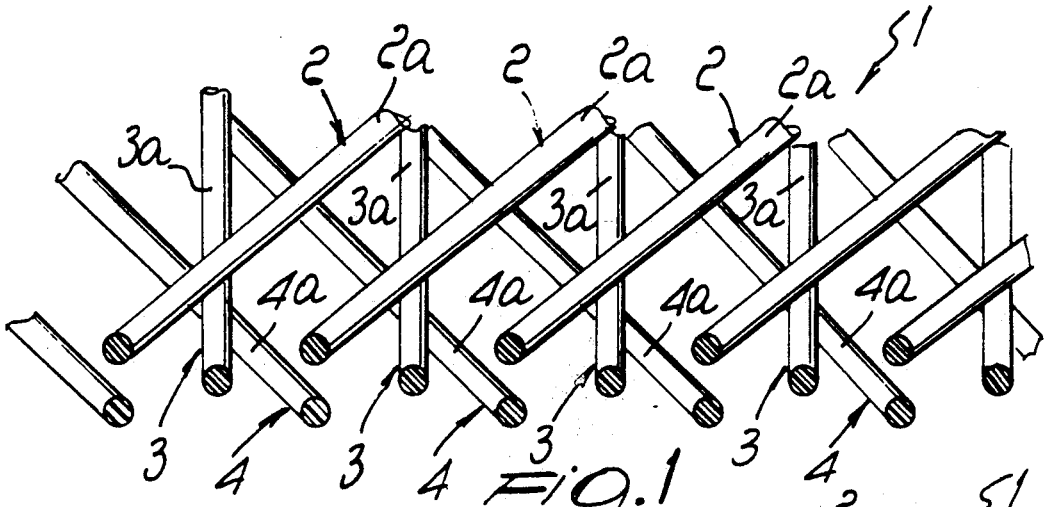
FIG. 1 is a schematic perspective view of the multiple-layer net structure according to the invention.
Figure 2:
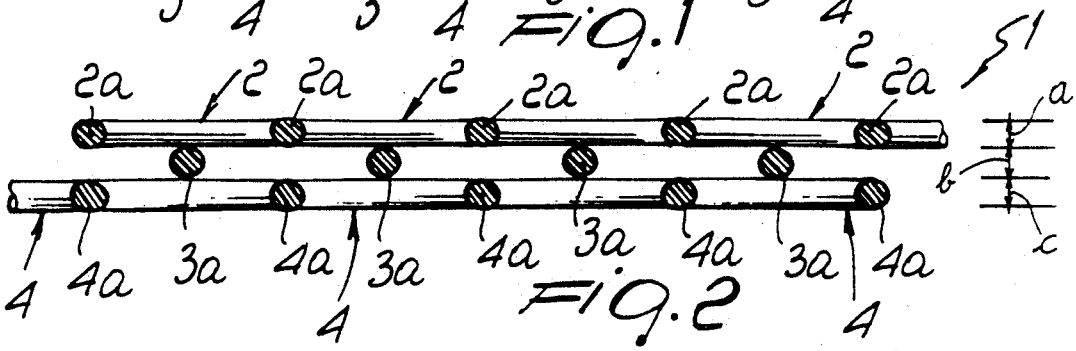
FIG. 2 is a sectional elevation view of the multiple-layer net.

With reference to the above figures, the multiple-layer net structure for fluid drainage, particularly for geotechnical use, according to the invention, is generally designated by the reference numeral 1. The net structure 1 comprises a first layer 2 constituted by a plurality of substantially mutually parallel wires 2*a*.

The layer 2 is rigidly connected to a second or intermediate layer 3 which is constituted by a plurality of mutually parallel wires 3*a* which are inclined with respect to the wires of the first layer.

An important feature of the multiple-layer net structure for fluid drainage, is a third layer, designated by the reference numeral 4, which is constituted by mutually parallel wires 4*a* which are inclined with respect to the wires of both the first and the second layers.

The layers have a thickness, taken as the geometric volume between the planes which are tangent to the wires of each layer, which can be different from one layer to another and furthermore allows for the interpenetration of the various layers, as will become apparent hereinafter.

Schematically, the letter "a" designates the thickness of the first layer, the letter "b" designates the thickness of the second layer and the letter "c" designates the thickness of the third layer.

Experimental tests which have been carried out have shown that it is essential that the layers be perfectly rigidly coupled together, i.e. that the wires of two adjacent layers be mutually rigidly coupled in the mutual connecting points; this rigid coupling can be obtained by coextrusion, glueing or any other method which in practice allows to obtain a monolithic product wherein the three layers are rigidly and stably joined together.

Experimentally, it has been observed that it is preferable to have the wires of the first layer inclined at 45° in one direction with respect to the wires of the second layer and to have the wires of the third layer inclined, with respect to the wires of the second layer, at 45° in the opposite direction, so as to obtain a perpendicular arrangement of the wires of the third layer with respect to those of the first one.

Figure 3:
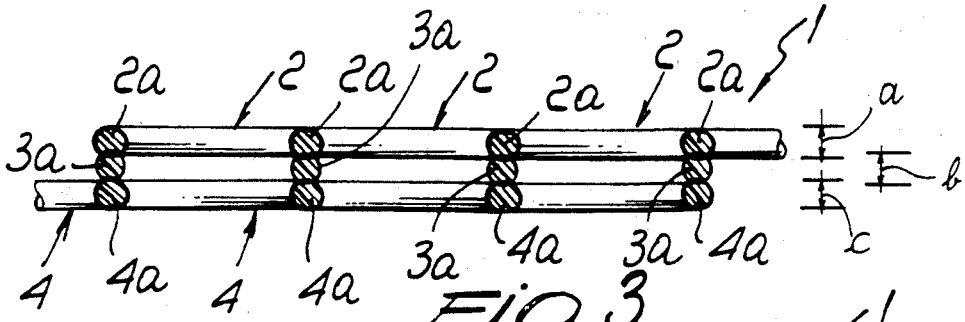
FIG. 3 is a sectional view of the net, taken at the intersection points of the wires of the various layers with mutually interpenetrating layers.
Figure 4:
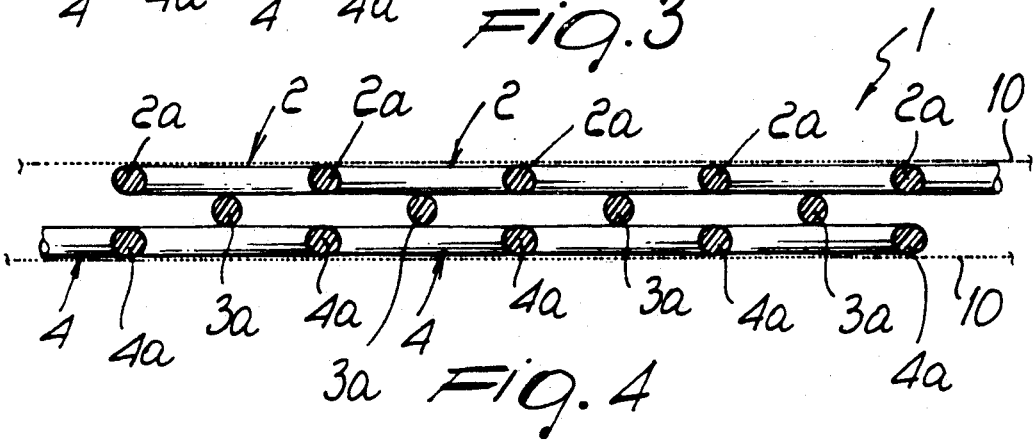
FIG. 4 is a schematic view of a net structure to which layers of fabric are applied.

Furthermore, it is preferable to provide the intersections among the wires of the various layers in the same point in plan view, i.e., as schematically illustrated in FIG. 3, to provide the node which joins the wires of the first layer and of the second layer on the same line, perpendicular to the plane of lay, where the node which connects the wires of the second and third layers is provided.

Furthermore, although it is preferable to use a 90° angle between the first and third layers with angles of 45° in both directions between the second and first layers and between the second and third layers, it is possible to use, for the first and second layers, an angle between the wires which is comprised between 20° and 70° in one direction and, for the wires between the second and third layers, an angle comprised between 20° and 70° in the opposite direction.

Furthermore, the thickness b of the second layer is preferably equal to the sum of the thicknesses of the first and third layers, i.e. of the outer layers.

As previously mentioned, it is possible to obtain an "interpenetration" of the thicknesses of the various layers, and it has been observed experimentally that the thickness of one layer must comprise at the most 50% of the thickness of the adjacent layer and that furthermore the thicknesses of the outer layers, i.e. of the first and third layers, must interpenetrate with the thickness of the intermediate layer by less than 70% of said intermediate layer.

The cross-sections of the wires 2*a*, 3*a* and 4*a* may have any shape, such as for example round, trapezoidal, triangular, rectangular or any other, which best adapts to the particular use to be made of the product, considering also the loads which must be withstood and the fluids which must be drained.

To the above it should also be added that it is possible to provide external layers of fabric or even continuous membranes, designated by the reference numeral 10, which can be present on both faces or on only one of said faces.

Experimental tests have shown that the net must have a total thickness, taken as sum of the useful thicknesses of the various layers, in excess of 3 mm.

As previously mentioned, drainage operations normally use biplanar nets, i.e. nets obtained in practice with two layers; the use of the third layer is not a simple addition, since there was a technical bias against using three series of wires due to the fact that it was not thought that the use of three series of wires, which besides are known in other applications, could lead to an increase in drainage capability.

In fact it could not be predicted that a structure such as the one described above could yield results which are surprisingly better than those of the systems used so far; in fact, if one analyzes the behavior of the flow in the drainage interstices, the system with three-wire net is not recommendable, since at least two transverse wires, and possibly three wires, oppose the direction of flow for an equal thickness of the drainage system itself, whereas in conventional systems with two intersecting wires the direction of flow is opposed by at least one transverse wire and possibly by two wires. This fact has always led to think that the use of three layers would lead to a greater hindrance of the flow due to the obstacle constituted by two or three wires with regard to drainage, so that this solution has never been put into practice.

A further remarkable aspect which has contributed to avoid suggesting the use of a three-wire system is the fact that when the flow is aligned with the direction of a parallel series of wires one may reasonably suppose that the typical two-wire system, in which each wire is equal to approximately 50% of the total net thickness, is preferable, since a greater direct cross-section is available for the elimination of the liquid flow.

In the case of the three-wire structure, with particular reference to a structure wherein the total available cross-section is equally divided among the three layers of wires, the direct cross-section, aligned with the direction of the flow, is equal to approximately 33% of the total, as opposed to 50% in the case of a two-wire net.

Surprisingly, experimental practical tests have shown that the use of the three-wire net, in the above mentioned applications, is a significant improvement. In fact, the transmissivity characteristics of the liquid to be drained, a parameter which can be measured in cubic meters per second per linear meter of fluid flow-rate and is dimensionally equal to $m^2$/sec, are improved when the net is used without external layers of fabric and are further improved by using nets with geo-compatible fabrics applied on one or both faces.

A test carried out on nets with two layers of wires or nets with three layers of wires with and without coupling of geo-compatible fabrics has proved that the net with three layers of wires is subject to a smaller reduction in the ability to transmit liquid in the two conditions, coupled and not coupled.

| Hydraulic gradient | 0,1 | | | 2,0 | | |
|---|---|---|---|---|---|---|
| Pressure (kPa) | 0 | 200 | 400 | 0 | 200 | 400 |
| Hydraulic flow-rate of two-wire net ($m^2$/sec) | 0,48 | 0,3 | 0,2 | 2 | 1,2 | 0,9 |
| Hydraulic flow-rate of two-wire net ($m^2$/sec) + geocompatible fabric on two sides | 0,22 | 0,092 | 0,058 | 0,82 | 0,4 | 0,25 |
| Flow reduction (%) | 54 | 69 | 71 | 59 | 67 | 72 |
| Hydraulic flow-rate of three-wire net ($m^2$/sec) | 0,55 | 0,4 | 0,35 | 2,05 | 1,9 | 1,5 |
| Hydraulic flow-rate of three-wire net ($m^2$/sec) + geocompatible fabric on two sides | 0,35 | 0,28 | 0,22 | 1,7 | 1,3 | 1,0 |
| Flow reduction | 36 | 30 | 37 | 17 | 32 | 33 |

The test was conducted at ambient temperature, with water as fluid to be drained and with the flow direction aligned with the wires of the lower layer in the case of the net with two series of wires and with the wires of the intermediate layer in the case of the net with three series of wires.

Each series of wires had a weight of approximately 450 g/$m^2$.

From what has been described above it can thus be seen that the invention achieves the intended aim and objects, and in particular the fact is stressed that a three-layer net is provided which allows to significantly increase the useful drainage characteristics for an equal overall thickness of the net.

The invention thus conceived is susceptible to numerous modifications and variations, all of which are within the scope of the inventive concept.

All the details may furthermore be any according to the requirements.

In practice, the materials employed, so long as they are compatible with the specific use, as well as the contingent shapes and dimensions, may be any according to the requirements.

I claim:

1. Fluid drainage net for geotechnical use comprising;

a first layer of sires arranged substantially parallel to each other and defining a plane of lay;

a second layer of wires arranged substantially parallel to each other and superimposed on said first layer of wires parallel to said plane of lay, said second layer of wires being inclined with respect to said first layer of wires, and connected thereto at a plurality of intersection nodes, said intersection nodes extending substantially perpendicular to said plane of lay;

a third layer of wires arranged substantially parallel to each other and superimposed on said second layer of wires, said third layer of wires being inclined with respect to said first layer of wires and said second layer of wires and connected to said second layer of wires at said intersection nodes;

wherein said first layer of wires is inclined by an angle of from 20 to 70 degrees with respect to said second layer of wires in one direction, wherein said third layer of wires is inclined by an angle of from 20 to 70 degrees with respect to said second layer of wires in an opposite direction.

2. Fluid drainage net for geotechnical use according to claim 1, wherein said drainage net has an overall thickness in excess of three millimeters.

3. Fluid drainage net for geotechnical use according to claim 1, wherein said first layer of wires and said third layer of wires have thickness dimensions, said second layer having a thickness substantially equal to a sum of said thickness dimensions of said first layer of wires and said third layer of wires.

4. Fluid drainage net for geotechnical use according to claim 1, wherein said first layer of wires is inclined to an angle of 90 degrees with respect to said third layer of wires, and wherein said first and third layer of wires are inclined at an angle of 45 degrees with respect to said second layer of wires.

5. Fluid drainage net for geotechnical use according to claim 1, wherein said first layer of wires, said second layer of wires and said third layer of wires are formed monolithically.

6. Fluid drainage net for geotechnical use according to claim 1, further comprising a membrane connected to one of said first layer of wires and said second layer of wires.

7. Fluid drainage net for geotechnical use according to claim 1, further comprising a membrane connected to said first layer of wires and a membrane connected to said second layer of wires.

8. Fluid drainage net for geotechnical use comprising;

a first layer of wires arranged substantially parallel to each other and defining a plane of lay;

a second layer of wires arranged substantially parallel to each other and superimposed on said first layer of wires parallel to said plane of lay, said second layer of wires being inclined with respect to said first layer of wires, and connected thereto at a plurality of intersection nodes, said intersection nodes extending perpendicular to said plane of lay;

a third layer of wires arranged substantially parallel to each other and superimposed on said second layer of wires, said third layer of wires being inclined with respect to said first layer of wires and said second layer of wires and connected to said second layer of wires at said intersection nodes;

wherein said first layer of wires is inclined by an angle of from 20 to 70 degrees with respect to said second layer of wires in one direction, said third layer of wires is inclined by an angle of from 20 to 70 degrees with respect to said second layer of wires in an opposite direction, and wherein said drainage net has an overall thickness in excess of three millimeters and wherein said first layer of wires, said second layer of wires and said third layer of wires are formed monolithically.

9. Fluid drainage net for geotechnical use according to claim 8, wherein said first layer of wires and said third layer of wires have thickness dimensions, said second layer having a thickness substantially equal to a sum of said thickness dimensions of said first layer of wires and said third layer of wires.

10. Fluid drainage net for geotechnical use according to claim 8, wherein said first layer of wires is inclined at an angle of 90 degrees with respect to said third layer of wires, and wherein said first and third layer of wires are inclined at an angle of 45 degrees with respect to said second layer of wires.

11. Fluid drainage net for geotechnical use according to claim 8, further comprising a membrane connected to one of said first layer of wires and said second layer of wires.

12. Fluid drainage net for geotechnical use according to claim 8, further comprising a membrane connected to said first layer of wires and a membrane connected to said second layer of wires.

13. A geotechnical fluid drainage method comprising the steps of;

(a) providing a drainage net comprising;

a first layer of wires arranged substantially parallel to each other and defining a plane of lay;

a second layer of wires arranged substantially parallel to each other and superimposed on said first layer of wires parallel to said plane of lay, said second layer of wires being inclined with respect to said first layer of wires, and connected thereto at a plurality of intersection nodes, said intersection nodes extending perpendicular to said plane of lay, and;

a third layer of wires arranged substantially parallel to each other and superimposed on said second layer of wires, said third layer of wires being inclined with respect to said first layer of wires and said second layer of wires and connected to said second layer of wires at said intersection nodes;

wherein said first layer of wires is inclined by an angle of from 20 to 70 degrees with respect to said second layer of wires in one direction, wherein said third layer of wires is inclined by an angle of from 20 to 70 degrees with respect to said second layer of wires in an opposite direction;

(b) arranging said net in a medium to be drained on an inclined plane, and (c) orienting said second layer of wires in alignment with a direction of fluid flow through said medium.

* * * * *